US005402900A

United States Patent [19]

Glynn

[11] Patent Number: 5,402,900

[45] Date of Patent: Apr. 4, 1995

[54] CHILD RESISTANT TURN-TO-POP CAP AND CONTAINER DEVICE

[75] Inventor: Kenneth P. Glynn, Raritan Township, Hunterdon County, N.J.

[73] Assignee: Ideal Ideas, Inc., Flemington, N.J.

[21] Appl. No.: 229,459

[22] Filed: Apr. 18, 1994

[51] Int. Cl.[6] ..... B65D 55/02

[52] U.S. Cl. ..... 215/225; 215/223; 215/235; 215/238

[58] Field of Search ..... 215/219, 220, 221, 223, 215/224, 225, 235, 237, 238; 222/153, 548

[56] References Cited

U.S. PATENT DOCUMENTS

| | | | |
|---|---|---|---|
| 3,398,848 | 8/1968 | Donovan | 215/224 |
| 3,955,696 | 5/1976 | Finke | 215/214 |
| 4,171,749 | 10/1979 | Obrist et al. | 215/256 |
| 4,535,904 | 8/1985 | O'Connor et al. . | |
| 4,573,598 | 3/1986 | Perry . | |
| 4,941,580 | 7/1990 | Julian | 215/235 |
| 4,991,729 | 2/1991 | Hunter . | |
| 5,161,706 | 11/1992 | Weinstein . | |
| 5,317,796 | 6/1994 | Hunter | 215/223 X |

*Primary Examiner*—Allan N. Shoap
*Assistant Examiner*—Stephen Cronin
*Attorney, Agent, or Firm*—Kenneth P. Glynn

[57] ABSTRACT

The present invention is directed to a child resistant snap cap container device which includes a container, a collar ring, a snap cap and a spring. The container has a neck with a lower retainer bead and an upper retainer bead thereon and has at least one stop located below the lower retainer bead and at least one derailer lift located above the lower retainer. The collar ring is fitted onto the neck and has undercut ledges located on its inside so as to fit under the lower retainer bead of the neck and in horizontal alignment with the stop(s). The snap cap has a snap lip and has derailers located on its inside wall. It is hinged to the collar ring. The cap is adapted to fit onto the neck with the derailers being located below the upper retainer bead. There is at least one spring located between the ring and the shoulder of the container which biases the ring upwardly such that the container cannot be opened merely by rotation but must be pushed down and rotated to open.

16 Claims, 1 Drawing Sheet

FIG. 1
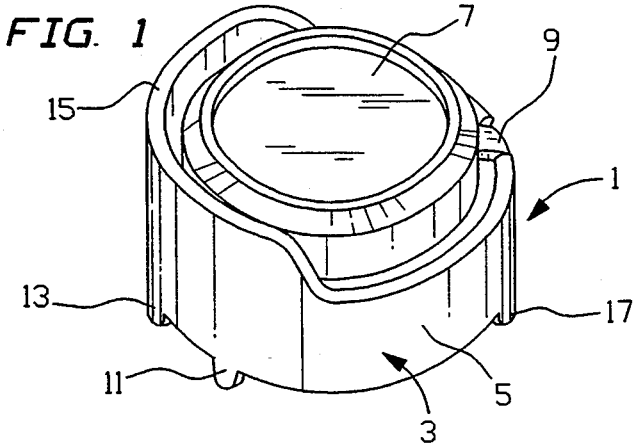
FIG. 2
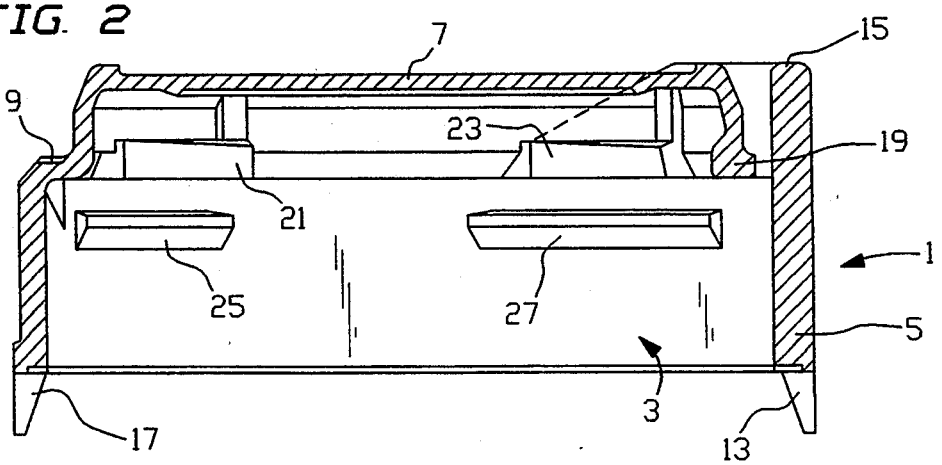
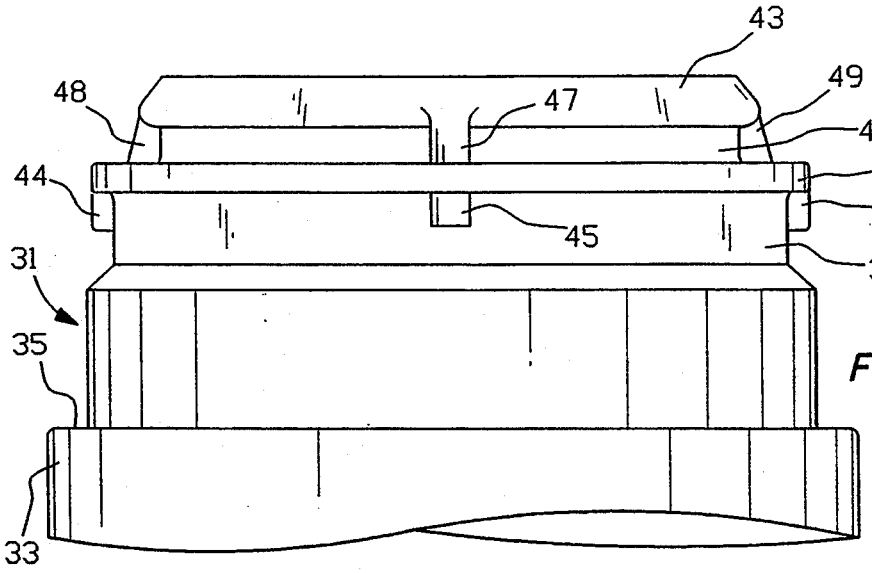
FIG. 3

CHILD RESISTANT TURN-TO-POP CAP AND CONTAINER DEVICE

BACKGROUND OF THE INVENTION

1. Field of the Invention

The present invention involves a childresistant snap cap container device which includes a container, a collar ring, a spring biasing the collar ring, and a snap cap. It may generally be used for securing pills, other medications and any other materials which should be kept from misuse by children.

2. Information Disclosure Statement

Numerous child resistant and tamper indicating containers and closures have been developed. The following patents show various prior art snap cap systems which have been developed to prevent or deter misuse of contents by children:

U.S. Pat. No. 4,535,904 to Michael C. O'Connor et al describes a tamper indicating closure which has a disc-shaped top with an upper skirt, upper annular bead, a lower skirt in center alignment with the upper skirt, and annular retention bead, a breakable bridge between the skirts and a tool aperture means to part the skirts.

U.S. Pat. No. 4,573,598 to Robert A. Perry describes a child-resistant package with a snap-on closure for a container. The neck finish of the container includes an annular retaining bead and the closure includes a top and a peripheral skirt. The skirt has a lifting tab on the outer surface and an internal locking lug adjacent to the lifting tab. An annular band is connected to the lower edge of the peripheral wall of the cover cap and includes a plurality of inwardly extending lugs insuring that the cover cap can not be removed until the band is severed.

U.S. Pat. No. 4,991,729 to Robert M. Hunter describes a closure cap which includes a rotatable member carrying inwardly projecting studs which pass through cylindrical channels of the container neck when properly aligned. Proper alignment is achieved by means of stops on the rotatable member and the closure cap which align the studs circumferentially with the channels. The rotatable member is provided with a frictional fit on the neck of the container so that as the closure cap is rotated, the rotatable member will stay in position on the container neck until the stops contact one another, thus properly indexing the studs on the rotatable member relative to channels in a rib on the container neck.

U.S. Pat. No. 5,161,706 to Jack Weinstein describes a twist and push snap-on, child resistant cap and container having an inner cap seal which is easily snapped onto a neck of a container and an outer cap. The outer cap has a top and sidewalls and has greater cross-sectional area than the inner cap, and receives and physically restrains the inner cap within the outer cap such that the inner cap may be moved upwardly and downwardly within it over specified distance. The outer cap includes a locking lug on its inside wall adapted to snap over a circumferential bead on the neck of the container. The device also includes a stop on the inside wall of the outer cap, a spring mechanism between the inner and outer cap and a bead located circumferentially about its neck with a break to allow the lug and stop of the outer cap to pass therethrough.

Notwithstanding the above prior art, there is no reference which teaches or suggests the present invention wherein the snap cap utilizes derailer and derailer lifts which cannot be activated unless a collar ring is pushed downwardly and rotated simultaneously.

SUMMARY OF THE INVENTION

The present invention is directed to a child resistant snap cap container device which includes a container, a collar ring, a snap cap and a spring. The container has a base of a predetermined shape, a shoulder and a circular neck. The neck has a lower retainer bead and an upper retainer bead thereon and has at least one stop located below the lower retainer bead and at least one derailer lift located above the lower retainer. The collar ring is fitted onto the neck of the container, and has a plurality of undercut ledges located on its inside so as to fit under the lower retainer bead of the neck and in horizontal alignment with at least one stop of the neck. The snap cap is hingedly connected to the collar ring, and has an inside wall with a plurality of derailers located thereon and has a snap lip thereon. The cap is adapted to fit onto the neck with the derailers being located below the upper retainer bead. There is at least one spring located between the ring and the shoulder of the container which biases the ring upwardly such that, when the snap cap is in a closed position with the lip located under the upper retainer bead and the ring is rotated, at least one of the undercut ledges of the ring contacts at least one stop on the neck so that the ring cannot be further rotated and the cap remains closed and such that, when the cap is in a closed position with the lip located under the upper retainer bead and the ring is pushed down and rotated, the undercut ledges are no longer aligned with the one stops and may pass thereunder, and at least one of the plurality of derailers of the cap interacts with at least one derailer lift of the neck so as to pop open the cap.

BRIEF DESCRIPTION OF THE DRAWINGS

The present invention will be more fully understood when the specification herein is taken in conjunction with the drawings appended hereto, wherein:

FIG. 1 shows an oblique right side view of a present invention turn-to-pop cap;

FIG. 2 shows a left side cut view of the cap shown in FIG. 1; and,

FIG. 3 shows a front view of an upper portion of a container adapted to receive the cap shown in FIGS. 1 and 2.

DETAILED DESCRIPTION OF THE INVENTION

Numerous child resistant closures have been developed for medications and other materials which could easily be misused or be harmful to children. Some caps are screw type caps while others are snap caps. Most snap cap systems having child resistant features either involve a plurality of pieces which must be manufactured separately or, in those which are unistructural, typically are relatively ineffective. The present invention device, on the other hand, involves both a collar ring which acts as a safety collar, as well as a snap cap which may, if the manufacturers so desire, be manufactured as a single structure. Referring now to FIGS. 1 and 2, there is shown in FIG. 1 an oblique right side view of a present invention turn-to-pop cap 1 and, there is shown in FIG. 2 a left side cut view of the cap 1 shown in FIG. 1. The cap 1 is generally referred to as a cap because it fits over a container shown in FIG. 3 and it is discussed in more detail in FIG. 3. However, cap 1 is, in fact, a collar ring 3 in combination with a snap cap lid 7. Collar ring 3 includes a ring wall 5 and is connected via hinge 9 to lid 7 as shown. There are spring legs such as legs 11, 13 and 17 but these spring legs do not have to take the form of legs as shown. They could be more like bowed strands or any other type of plastic springs which are known in the closure art without deviating from the scope of the present invention. Ring wall 5 has an extended shoulder portion 15 which extends upwardly beyond the lid snap lip 19 so as to prevent a child from prying under that lip to open the lid 7. The entire ring wall 5 could be higher, but the design shown in FIGS. 1 and 2 allow for makimum security by shielding the lip 19 from user while allowing for maximum fold-back on hinge 9 of lid 7 when it is open. On the inside wall of collar ring 3 are undercut ledges 25 and 27. These ledges form two separate functions and are important features to the invention. First, they are undercut and thus tapered so as to be snapped on to a container such as that shown in FIG. 3 which is described below. Second, they will be in horizontal alignment with stops on a container to prevent the collar ring from being rotated into a position where the lid 7 will open. A plurality of such undercut ledges would be included and two or more may be used.

Lid 7 has on its inside wall at least one derailer ramp and, here includes derailer ramps 21 and 23 as shown. These ramps will respond to derailer lifts on the neck of a container so as to cause lid 7 to automatically snap open. However, ledges 25 and 27 will hit stops on a container before the derailers are activated, unless collar ring 3 is pushed down so that spring legs 11, 13 and 17 would yield, thereby lowering undercut ledges 25 and 27 below stops and thereby enabling further rotation of collar ring 3 so as to activate derailer ramps 21 and 23 so as to automatically open lid 7. The extent of rotation for fully activating the lift ramps would be such that the undercut ledges would be realigned to areas beyond stops and when the user simply let go of the collar ring 3, the spring legs would raise that the collar back up so that the undercut ledges were again aligned with stops. Thus, when the user snapped the cap for closure, it would automatically be in the child resistant mode.

Referring now to FIG. 3 as well as FIGS. 1 and 2 below, FIG. 3 shows a container 31 which includes a base 33, a shoulder 35 and an incut 37. There is a lower retainer bead 39 and an upper retainer bead 43 and a second incut 41 between said lower retainer bead 39 and said upper retainer bead 43. Below lower retainer bead 39 are a plurality of stops or at least one stop, but in this case, stops 44, 45 and 46, as shown. Above lower retainer bead 39 and below upper retainer bead 43 are derailer lifts such as derailer lifts 47, 48 and 49. When cap 1 of FIGS. 1 and 2 is initially secured to container 31, the tapered portions of undercut ledges 25 and 27 slide over the lower retainer bead 39 but then cannot be lifted upwardly therefrom so that attachment becomes permanent but rotatable. Spring legs 11, 13 and 17 (and others which may be included but are not shown) will rest on shoulder 35 and will thereby horizontally align undercut ledges 25 and 27 with stops such as stops 44, 45 and 46. Thus, rotation of collar ring 3 will be inhibited when the ledges 25 and 27 hit stops such as stops 44, 45 and 46. Further, derailer ramps such as derailer ramps 21 and 23 will not be able to reach the derailer lifts 47, 48 and 49 unless a user first presses down on collar ring 3 and then rotates collar ring 3 while down so that undercut ledges 25 and 27 go under stops 44, 45 and 46, thereby enabling the derailer ramps 21 and 23 to be activated by derailer lifts such as 47, 48 and 49, thereby automatically snapping open lid 7. When lid 7 is in its closed position, lid snap lip 19 will secure lid 7 by lip 19 being attached to the underside of upper retainer bead 43.

Obviously, numerous modifications and variations of the present invention are possible in light of the above teachings. For example, the collar ring is described above as being snapped on permanently by one of the dual functions of the undercut ledges. However, the collar ring could have threads below the ledges which could be irreversible, e.g. one way ratchet threads, and still be viable. It is therefore understood that within the scope of the appended claims, the invention may be practiced otherwise than as specifically described herein.

What is claimed is:

1. A child resistant snap cap container device, which comprises the following elements:

a. ) a container having a base of a predetermined shape, having a shoulder and having a circular neck, said neck having a lower retainer bead and an upper retainer bead thereon and said neck having at least one stop located below said lower retainer bead and having at least one derailer lift located above said lower retainer;

b. ) a collar ring fitted onto said neck of said container, said ring having a plurality of undercut ledges located on the inside of said ring so as to fit under said lower retainer bead of said neck and in horizontal alignment with said at least one stop of said neck;

c.) a snap cap hingedly connected to said collar ring, said snap cap having an inside wall with a plurality of derailers located thereon and having a snap lip thereon, said cap being adapted to fit onto said neck with said derailers being located below said upper retainer bead; and, d.) at least one spring located between said ring and said shoulder of said container and biasing said ring upwardly; such that, when said snap cap is in a closed position with said lip located under said upper retainer bead and said ring is rotated, at least one of said undercut ledges of said ring contacts said at least one stop on said neck, said ring cannot be further rotated and said cap remains in said closed position, and such that, when said cap is in a closed position with said lip located under said upper retainer bead and said ring is pushed down and rotated, said undercut ledges are no longer aligned with said at least one stop and may pass thereunder and at least one of said plurality of derailers of said cap interacts with said at least one derailer lift of said neck so as to pop open said cap.

2. The device of claim 1 wherein said plurality of derailers of said cap are located above said plurality of undercut ledges.

3. The device of claim 1 wherein said at least one spring is integrally formed with said collar ring.

4. The device of claim 3 wherein said at least one spring is at least one leg extending from said collar ring at a location lower than and opposite from said hinge.

5. The device of claim 2 wherein said at least one spring is integrally formed with said collar ring.

6. The device of claim 5 wherein said at least one spring is at least one leg extending from said collar ring at a location lower than and opposite from said hinge.

7. The device of claim 1 wherein said hinge is a living hinge and said cap is integrally formed with said collar ring.

8. The device of claim 7 wherein said at least one spring is integrally formed with said collar ring.

9. The device of claim 8 wherein said at least one spring is at least one leg extending from said collar ring at a location lower than and opposite from said hinge.

10. The device of claim 1 wherein said collar ring has an extended collar portion located adjacent to said snap lip of said cap.

11. The device of claim 1 wherein there are a plurality of said stops, and a plurality of said derailer lifts.

12. The device of claim 2 wherein there are a plurality of said stops and a plurality of said derailer lifts.

13. The device of claim 3 wherein there are a plurality of said stops and a plurality of said derailer lifts.

14. The device of claim 4 wherein there are a plurality of said stops and a plurality of said derailer lifts.

15. The device of claim 11 wherein the number of said stops equals the number of said derailer lifts.

16. The device of claim 15 wherein said stops and said derailer lifts are in vertical alignment with one another.

* * * * *